US005364279A

United States Patent [19]

Betz et al.

[11] Patent Number: 5,364,279

[45] Date of Patent: Nov. 15, 1994

[54] FASTENING ARRANGEMENT FOR CONNECTIONS AT IGNITION COILS FOR MOTOR VEHICLES

[75] Inventors: Dieter Betz, Vaihingen/Enz; Karl-Heinz Nuebel, Schwieberdingen; Werner Grewe, Leonberg; Oskar Balcarek, Ludwigsburg, all of Germany

[73] Assignee: Robert Bosch GmbH, Stuttgart, Germany

[21] Appl. No.: 941,445

[22] PCT Filed: Oct. 17, 1991

[86] PCT No.: PCT/DE91/00813

§ 371 Date: Oct. 23, 1992

§ 102(e) Date: Oct. 23, 1992

[87] PCT Pub. No.: WO92/13354

PCT Pub. Date: Aug. 6, 1992

[30] Foreign Application Priority Data

Jan. 25, 1991 [DE] Germany ..... 4102145

[51] Int. Cl.[5] ..... H01R 9/09

[52] U.S. Cl. ..... 439/76; 336/107

[58] Field of Search ..... 439/76, 894; 336/107, 336/192

[56] References Cited

U.S. PATENT DOCUMENTS

| | | | |
|---|---|---|---|
| 4,290,664 | 9/1981 | Davis et al. | 439/638 |
| 4,723,196 | 2/1988 | Hofmeister et al. | 439/76 |
| 4,766,406 | 8/1988 | Kurgan et al. | 336/65 |
| 4,799,893 | 1/1989 | Ogawa et al. | 439/76 |
| 4,850,884 | 7/1989 | Sawai et al. | 439/76 |
| 4,889,497 | 12/1989 | Riches | 439/76 |
| 5,006,764 | 4/1991 | Swanson et al. | 439/76 |
| 5,011,417 | 4/1991 | Matsumoto et al. | 439/76 |
| 5,064,388 | 11/1991 | Paladel | 439/76 |
| 5,120,231 | 6/1992 | Masumoto | 439/76 |

FOREIGN PATENT DOCUMENTS

| | | |
|---|---|---|
| 344387 | 6/1989 | European Pat. Off. . |
| 395513 | 10/1990 | European Pat. Off. . |
| 2204909 | 5/1974 | France . |
| 1095397 | 12/1960 | Germany . |

*Primary Examiner*—Gary F. Paumen

*Attorney, Agent, or Firm*—Michael J. Striker

[57] ABSTRACT

The fastening arrangement for electrical connection to an ignition coil includes a housing; an epoxy resin circuit board in the housing and having a plurality of conductor paths electrically insulated from each other, each of which are provided with at least two ends having a bore hole for electrical connection to the primary windings; and a connection plug including elements for easily securing it to the housing and a plurality of electrical contacts extending from an exterior side of the plug and into the housing on an interior side. The housing is provided with a recess to accommodate the connection plug and a guide groove in the recess in which a projecting guide element of an outer peripheral flange of the connecting plug is pressed to fix the connection plug to the housing. The electrical contacts are electrically insulated from each other and each of them includes a pin on its interior end. The pins of the electrical contacts project through respective bore holes in the conductor paths and are soldered with the respective conductor paths so that the connection plug and the printed circuit board form a primary plug unit for making electrical connection to the ignition coil.

7 Claims, 2 Drawing Sheets

FASTENING ARRANGEMENT FOR CONNECTIONS AT IGNITION COILS FOR MOTOR VEHICLES

BACKGROUND OF THE INVENTION

The present invention relates to a fastening arrangement for connections at ignition coils for motor vehicles.

Fastening arrangements in ignition coil housings with multiple-spark ignition coils for the connection of the primary windings of the ignition coils accommodated in the ignition coil housing are known in general. Together with a connection plug, these fastening arrangements, which are also known as current rails, form a constructional unit of injection-molded plastic and have two metallically blank hooks for each ignition coil which electrically contact the end portions of the primary windings. The current rails are formed by metallic strips with the hooks formed on at the ends and are inserted into a plastics injection molding die as insertion parts for the manufacture of the connection plug.

Since the current rails conduct different electrical potentials during the operation of the ignition coil, but the fastening arrangement is to be constructed so as to economize on space as much as possible, the current rails must be positioned in the injection molding die so as to be close together without contacting one another and must be fixed in such a way that their initial position is not changed as a result of the injection pressure. This fastening arrangement is expensive to produce, cost-intensive and has high reject rates.

ADVANTAGES OF THE INVENTION

It is an object of the present invention to provide a fastening arrangement for electrical connection to an ignition coil which does not have the disadvantages of the prior art fastening arrangements described above.

SUMMARY OF THE INVENTION

In keeping with this object and others which will become more apparent hereinafter, one aspect of the present invention resides, briefly stated, in a fastening arrangement for electrical connection to an ignition coil including at least one secondary winding and at least one primary winding having two end portions, which arrangement comprises a housing; a printed circuit board having a plurality of conductor paths electrically insulated from each other, each of the conductor paths having at least two bore holes for electrical connections to the primary windings; and a connection plug having an exterior side and an interior side and means for fixing the connection plug to the housing as well as a plurality of electrical contacts extending from an exterior side into the housing on an interior side. The printed circuit board is an epoxy resin circuit board. The housing is provided with a recess to accommodate the connection plug having a guide groove. The means for fixing the connection plug to the housing comprises an outer peripheral flange provided on the connection plug which has a projecting guide element pressed into the guide groove to hold the connection plug to the housing when the connection plug is fixed on the housing. The electrical contacts are electrically insulated from each other and each of the electrical contacts includes a pin on its interior end and the pins of the electrical contacts project through respective bore holes and are soldered with respective conductor paths so that the connection plug and the printed circuit board form a primary plug unit for making electrical connection to the primary coils.

This printed circuit board functions more reliably than the current rails and is produced from fiber glass-reinforced epoxy resin.

When filling the completely assembled ignition coil with casting resin, the epoxy resin of the printed circuit board can bond with the casting resin better than with the plastics injection-molded current rails. This results in improved resistance to aging of the ignition coil with respect to high temperature differences at the ignition coil during operation in a motor vehicle.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
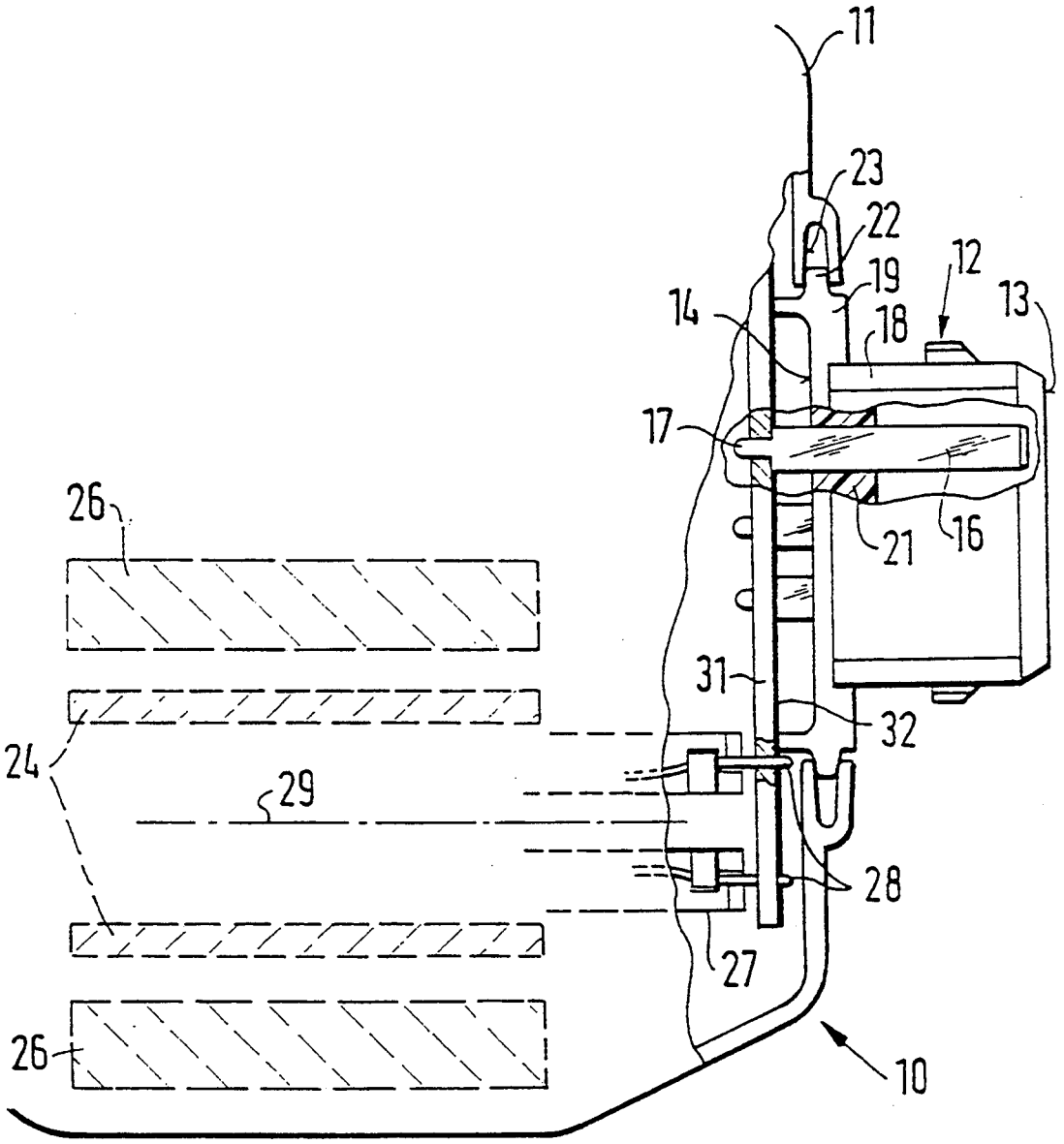
FIG. 1 shows parts of the ignition coil with a two-part housing; the upper part of the housing is shown partially in section and the lower part of the housing is shown from the top, partially in section, with the fastening arrangement 1.

FIG. 1 shows a part of an ignition coil 10 with a housing 11 and with a connection plug 12 partially projecting out of the housing 11. The connection plug 12 has an exterior side 13 at its end remote of the housing 11 and an interior side 14 at its other end.

Three tongue-shaped contacts 16 which are electrically insulated from one another and taper toward the interior side 14 extend from interior side 14 to the exterior side 13. Each of the electrical contacts 16 has a pin 17 on its interior side 14 for making an electrical connection.

The connection plug 12 has a sleeve 18 and an outer peripheral flange 19 as main components in addition to the metallic contacts 16.

The sleeve 18 is box-shaped and opens toward the exterior side 13. It encloses the contacts 16 on the exterior side 13 with joint clearance so that coupling parts of a counter-plug between contacts 16 and collar 18 can be attached to the contacts 16, the coupling parts not being shown in the drawing.

The sleeve 18 is sealed internally toward the interior side 14 by a base 21 which connects with the flange 19 projecting from the sleeve 18 at the front.

The flange 19 has an projecting guide element 22 which can be pressed into a guide groove 23 which is provided in a recess 20 of the housing 11 and thus fixes the connection plug 12 at the housing 11.

Since the described embodiment example concerns a two-spark ignition coil, two primary windings 24 and two secondary windings 26 are provided in the housing 11, one of which is shown schematically in FIG. 1. Each winding 24, 26 is wound on a separate winding body, a portion of a primary winding body 27 being shown in FIG. 1.

Two end portions 28 of the primary winding 24 arranged on the primary winding body 27 are fixed at the front of the latter. The end portions 28, winding start and winding end, of the primary winding 24 are positioned in such a way that they project from the primary winding body 27 to provide an insertion length of approximately 4 mm. The end portions 28 lie parallel to a longitudinal axis 29 of the primary winding 24 and are directed at a right angle relative to the portion of the housing 11 which has the recess 20 for receiving the connection plug 12.

The end portions 28 of the two primary windings 24 as well as the pins 17 of the contacts 16 of the connection plug 12 can be connected with a connection body in the form of a carrier plate, designated as printed circuit board 31.

Figure 2:
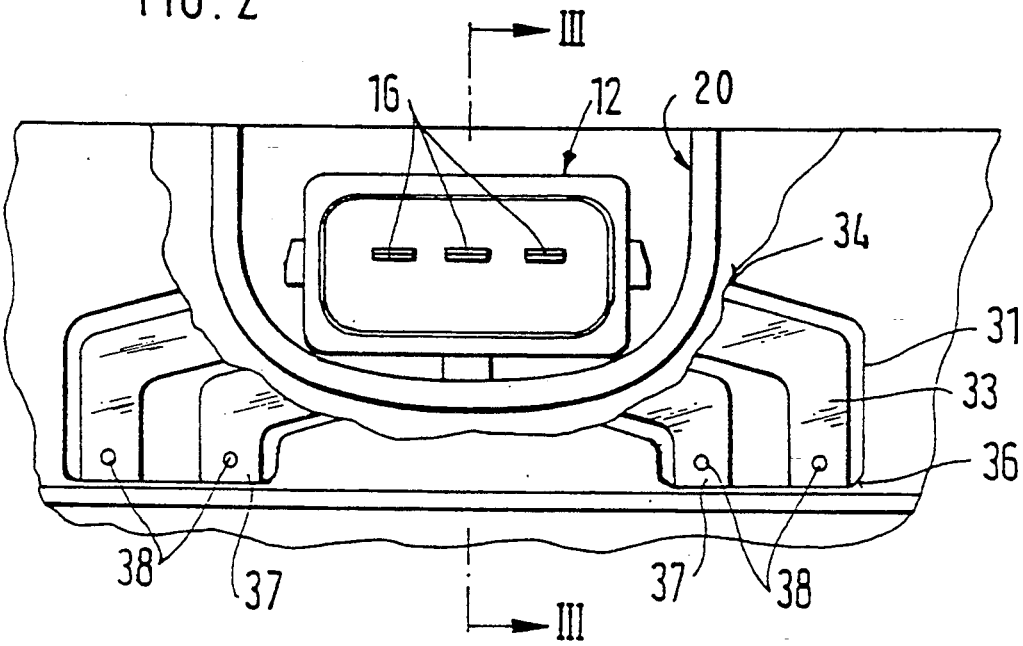
FIG. 2 shows the fastening arrangement in a side view.

The printed circuit board 31 includes a fiber-glass reinforced cured epoxy resin and has so-called conductor paths 33 which can conduct electrical current and which are etched out of a copper film 32 in an etching process and shown in section in FIG. 2.

The conductor paths 33 run separately from one another and are electrically insulated from one another since the printed circuit board 31 is produced from electrically nonconductive material. They extend from a head side 34 on the connection side to a foot side 36 adjacent to the end portions 28 of the primary windings 24.

In the described embodiment example, three conductor paths 33 are required for the connection of the two primary windings 24, specifically two for an end portion 28 of each of the primary windings 24. The remaining end portion 28 of each of the primary windings be connected to a common third conductor path 33 during the operation of the ignition coil 10 so as to be connected to the same potential. This third conductor path 33 branches toward the foot side 36 into two separately running connection paths 37. Each of the connection paths 37 along with one of the other two conductor paths 33 forms spatially adjacent connection spaces for the two primary windings 24.

Each of the connection paths 33 and each connection path 37, respectively, has a bore hole 38 on the foot side 36 for the connection of the primary windings 24.

Figure 3:
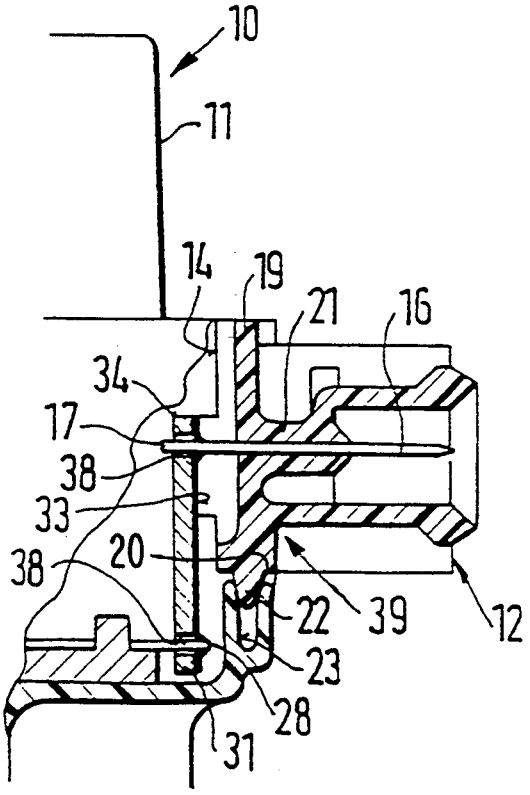
FIG. 3 shows the fastening arrangement in section along line III—III of FIG. 2.

A bore hole 38 is also arranged in each instance on the head side 34 in the printed circuit boards 33 for the connection of the contacts 16 of the connection plug 12 as shown in FIG. 3. Whereas the distance between the bore holes 38 on the foot side 36 corresponds to the end portions 28 of the primary windings 24 determined at the primary winding body 27, the distance between the bore holes 38 on the head side 34 is selected so as to correspond to the distance between the contacts 16 of the connection plug 12.

The fastening arrangement for the connections of the ignition coil 10 according to FIG. 3 is effected in that the pins 17 of the contacts 16 are first inserted through the bore holes 38 of the head side 34 of the printed circuit board 31 and each pin 17 is then soldered with a conductor path 33.

It will be understood that each of the elements described above, or two or more together, may also find a useful application in other types of constructions differing from the types described above.

While the invention has been illustrated and described as embodied in a fastening arrangement for connections at ignition coils for motor vehicles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A fastening arrangement for electrical connections to an ignition coil of a motor vehicle, said ignition coil including at least one secondary winding and at least one primary winding, each of said primary windings having two end portions, said fastening arrangement comprising a housing;

a printed circuit board having a plurality of conductor paths electrically insulated from each other, each of said conductor paths having at least two bore holes for electrical connection to said at least one primary winding; and a connection plug having an exterior side and an interior side and comprising means for fixing said connection plug to said housing and a plurality of electrical contacts extending from said exterior side and into said housing on said interior side, wherein said printed circuit board is an epoxy resin circuit board, said housing is provided with a recess to accommodate said connection plug, said recess having a guide groove, and said means for fixing said connection plug to said housing comprises an outer peripheral flange provided on said connection plug, said outer peripheral flange having a projecting guide element fitting in said guide groove to hold said connection plug to said housing when said connection plug is pressed into said recess in said housing, and wherein said electrical contacts are electrically insulated from each other and each of said electrical contacts includes a pin on its interior end and said pins of said electrical contacts project through respective ones of said bore holes and are soldered with respective ones of said conductor paths so that said connection plug and said printed circuit board form a primary plug unit for making electrical connection to said at least one primary coil.

2. An arrangement as defined in claim 1, wherein said printed circuit board is inside said housing.

3. An arrangement as defined in claim 1, wherein said printed circuit board comprises an insulating material coated with a conducting material.

4. An arrangement as defined in claim 3, wherein said conducting material is a copper film and said conductor paths are etched out of said copper film.

5. An arrangement as defined in claim 4, wherein said conductor paths are arranged on a side of said printed circuit board adjacent to said connection plug.

6. An arrangement as defined in claim 1, further comprising a primary winding body for each of said primary windings, and wherein said two end portions of each of said primary windings are held fixed in said housing by said primary winding body and are inserted into said bore holes of said conductor paths and electrically connected with said conductor paths.

7. An arrangement as defined in claim 1, wherein said ignition coil has two primary winding bodies and two of said primary windings, said primary windings being wound around respective ones of said primary winding bodies.

* * * * *